US005253982A

United States Patent [19]

Niemiec et al.

[11] Patent Number: 5,253,982

[45] Date of Patent: Oct. 19, 1993

[54] ELECTROHYDRAULIC PUMP LOAD CONTROL SYSTEM

[75] Inventors: Albin J. Niemiec, Sterling Heights; James V. Bloomquist, Bloomfield, both of Mich.

[73] Assignee: Vickers, Incorporated, Troy, Mich.

[21] Appl. No.: 980,242

[22] Filed: Nov. 23, 1992

[51] Int. Cl.[5] ..... F04B 49/00

[52] U.S. Cl. ..... 417/38; 417/371

[58] Field of Search ..... 417/38, 371

[56] References Cited

U.S. PATENT DOCUMENTS

| | | | |
|---|---|---|---|
| 2,763,214 | 8/1956 | White | 417/371 X |
| 3,563,671 | 2/1971 | Weber | 417/38 |
| 5,064,347 | 11/1991 | La Valley, Sr. | 417/38 |

OTHER PUBLICATIONS

*Vickers Industrial Hydraulics Manual*, Vickers, Incorporated, 1989 pp. 19-5 through 19-7.

*Primary Examiner*—Richard A. Bertsch

*Assistant Examiner*—Alfred Basichas

*Attorney, Agent, or Firm*—Barnes, Kisselle, Raisch, Choate, Whittemore & Hulbert

[57] ABSTRACT

An electrohydraulic pump load control system that includes a fluid-cooled integrated electric motor/hydraulic pump for delivering fluid under pressure to an accumulator that stabilizes pump output pressure while accommodating changes in fluid flow. A pressure sensor is coupled to the accumulator to provide an electrical signal as a function of fluid pressure at the accumulator. An electronic controller applies electrical power to the pump motor, and is responsive to the electrical signal from the pressure sensor for terminating application of electrical power to the pump motor when pressure at the accumulator reaches the desired threshold. The electronic motor controller controls both application and termination of electrical power to the motor to energize and de-energize the motor at predetermined rates responsive to pressure differential thresholds at the pressure sensor.

3 Claims, 2 Drawing Sheets

ELECTROHYDRAULIC PUMP LOAD CONTROL SYSTEM

The present invention is directed to a system for controlling load applied to an electrohydraulic pump coupled to an accumulator.

BACKGROUND AND SUMMARY OF THE INVENTION

In conventional hydraulic pump/accumulator circuits, the load on the pump is controlled by hydraulic or electrohydraulic valves responsive to fluid pressure at the accumulator. During normal operation, the pump feeds hydraulic fluid to the accumulator and to the system load coupled to the accumulator. When fluid pressure at the accumulator and load reaches the desired maximum pressure level, valves deliver fluid from the pump outlet to the sump bypassing the accumulator and load. Although pump load is reduced, the pump continues to operate, generating noise and consuming energy. In systems where the pump is coupled to an electric motor, electrical energy applied to the motor continues to generate heat at the motor, which must be dissipated. The electric power that turns the shaft is termed real/power. Apparent power is line voltage multiplied by current, and includes both the real power and the out-of-phase current component for establishing magnetic lines of flux. This magnetizing component is needed even when the electric motor is unloaded, and is approximately the same magnitude whether the motor is idling or operating at full load.

It is a general object of the present invention to provide an electrohydraulic pump load control system that reduces overall noise level and power consumption by removing application of electrical power from the motor/pump when accumulator/load fluid pressure reaches the desired level. Another object of the invention is to provide an electrohydraulic pump load control system of the described character in which power surges and transients are eliminated as power is selectively applied to the pump motor.

An electrohydraulic pump load control system in accordance with the present invention includes a hydraulic pump coupled to an electric motor for delivering fluid under pressure to an accumulator that stabilizes pump output pressure while accommodating changes in fluid flow. A pressure sensor is coupled to the accumulator to provide an electrical signal as a function of fluid pressure at the accumulator. An electronic controller applies electrical power to the pump motor, and is responsive to the electrical signal from the pressure sensor for terminating application of electrical power to the pump motor when pressure at the accumulator reaches the desired threshold. If disturbance in the electric power supply can be tolerated, the controller may comprise a relay contact electric motor starter. Preferably, the electronic motor controller controls both application and termination of electrical power to the motor to energize and de-energize the motor at predetermined rates responsive to pressure differential thresholds at the pressure sensor.

Most preferably, the motor and pump comprise an integrated electric motor/hydraulic pump unit in which the motor is cooled by hydraulic fluid that flows through the pump. In an air-cooled motor design, the frequency of starting and stopping the motor is dependent upon temperature build-up in its rotor and stator.

In a fluid-cooled motor/pump, as is preferred, the frequency of starting and stopping may be considerably increased because of superior heat dissipation. The reduced total input power requirements and increased frequency of staring an oil cooled electric motor/hydraulic pump unit makes this system attractive in machine tool and other applications.

BRIEF DESCRIPTION OF THE DRAWING

The invention, together with additional objects, features and advantages thereof, will be best understood from the following description, the appended claims and the accompanying drawing in which:

DETAILED DESCRIPTION OF PREFERRED EMBODIMENTS

Figure 1:
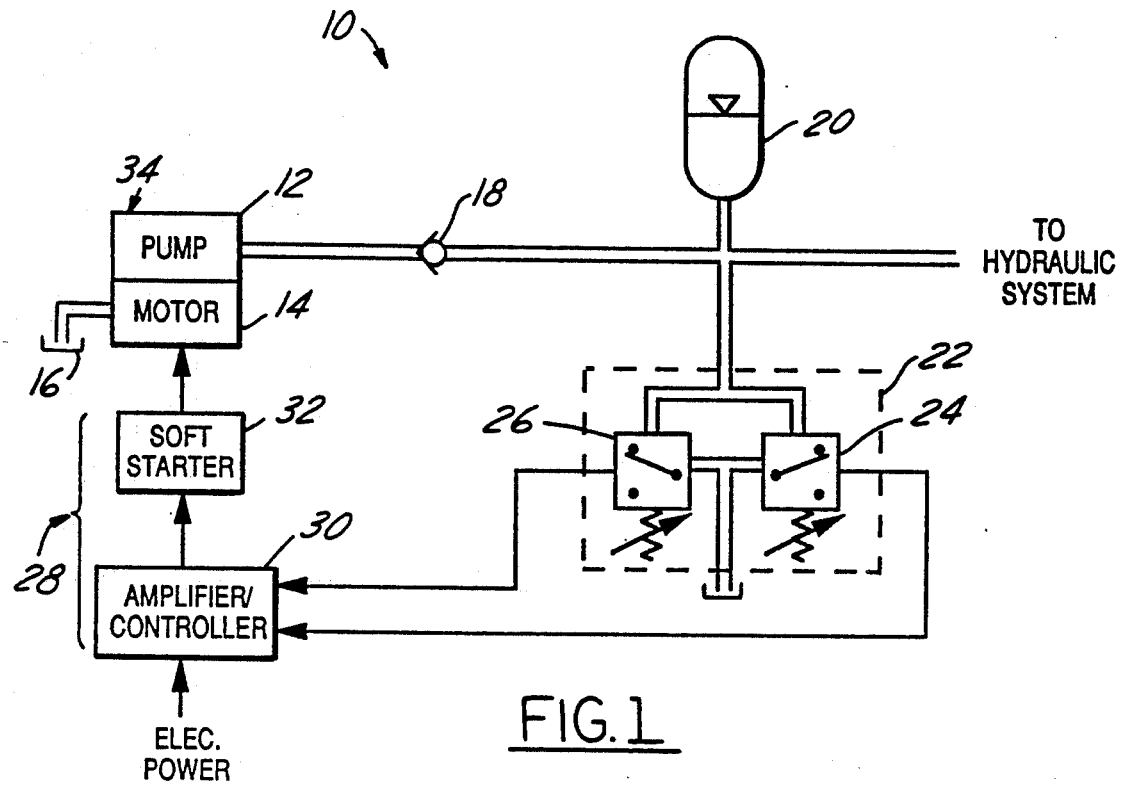
FIG. 1 is a schematic diagram of an electrohydraulic pump load control system in accordance with a presently preferred embodiment of the invention.

FIG. 1 illustrates an electrohydraulic pump load control system 10 in accordance with the present invention as comprising a hydraulic pump 12 driven by an electric motor 14 for feeding hydraulic fluid under pressure from a sump 16 through a check valve 18 to an accumulator 20. A dual pressure switch 22 is coupled to accumulator 20, and to the hydraulic system or load (not shown) coupled to accumulator 20. Dual pressure switch 22 includes a first electrical switch 24 for providing a switch closure signal (i.e., transition from open to closed or closed to open) when hydraulic fluid pressure at accumulator 20 exceeds a first preselected threshold, and a second electrical switch 26 that provides a switch closure signal when fluid pressure at accumulator 20 decreases below a second lower threshold. An electronic motor controller 28 includes an amplifier/controller 30 responsive to pressure switches 24,26 for applying electrical power to motor 14 through a soft starter circuit 32.

In operation, motor controller 28 normally applies electrical power to motor 14, which drives pump 12 to feed fluid under pressure to accumulator 20 and the system load coupled thereto. When fluid pressure at accumulator 20 reaches the upper threshold of switch 24, controller 30 terminates application of electrical power to motor 14, thereby de-energizing pump 12. Check valve 18 prevents reverse flow of fluid from accumulator 20 to pump 12 when the pump is shut down. When pressure at accumulator 20 decreases below the threshold of switch 26, amplifier/controller 30 reapplies electrical power to motor 14. Soft starter circuit 32, which in and of itself if of conventional construction, applies and removes electrical power to and from motor 14 at a controlled rate so as to control acceleration and deceleration of the motor. This prevents power surges, and voltage and current transients in the electrical power lines when motor 14 is energized or de-energized. Exemplary soft starters 32 are a model HV unit marketed by Motorronics, Inc. of Clearwater, Fla., and a Lectron solid state motor controller marketed by Baldor Electric Co. of Fort Smith, Ark.

Dual pressure switch 22 in and of itself is of conventional construction, and includes facility for adjusting the sensing thresholds of switches 24,26. Dual pressure switch 22 may be replaced by other pressure sensing means, such as a solid state pressure sensor that feeds a single electrical signal to amplifier/controller 30 indicative of hydraulic fluid pressure, with amplifier/controller 30 including electronic circuitry for sensing the desired pressure thresholds. Pump/motor 12,14 in the preferred implementation of the invention takes the form of an integrated motor/pump unit 34 in which the motor and pump are provided in a unitary closely coupled assembly. Examples of such integrated electric motor/hydraulic pump units are disclosed in U.S. Pat. No. 4,729,717 and U.S. application Ser. No. 07/687,173, both assigned to the assignee hereof. Most preferably, fluid fed to the pump is circulated through the motor for cooling the motor components, and thereby increasing horsepower and pumping capability of the integrated motor/pump unit.

Figure 2:
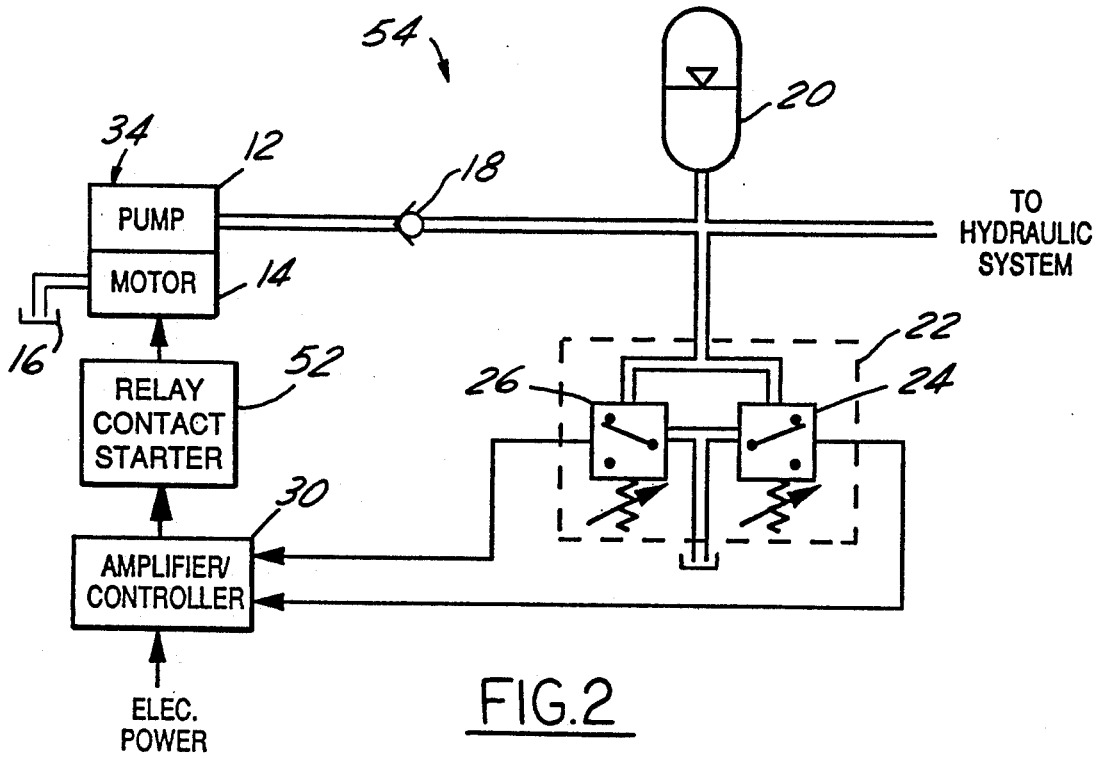
FIG. 2 is a schematic diagram of an electrohydraulic pump load control system in accordance with a modified embodiment of the invention.

FIG. 2 illustrates a modified system 54, in which reference numerals identical to those in FIG. 1 illustrate identical components. Soft starter 32 in FIG. 1 is replaced in FIG. 2 by a relay contact starter 52. Starter 52 has contacts that are responsive to control signals from controller 30 and pressure switch 22 for selectively applying power to motor 14. Relay contact starter 52 is an on/off type starter without controlled acceleration or deceleration.

Figure 3:
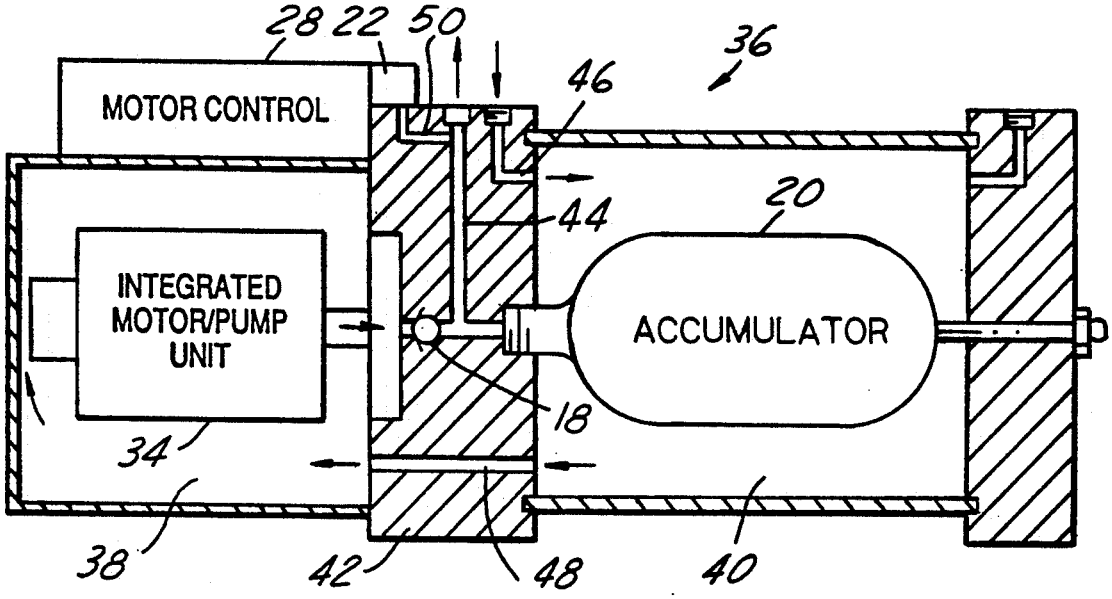
FIG. 3 is a schematic diagram of an exemplary integrated motor/pump/accumulator/control unit.

FIG. 3 illustrates an exemplary integrated motor/-pump/accumulator unit 36, in which integrated motor/pump unit 34 and accumulator 20 are mounted within corresponding chambers 38,40 on opposite sides of a fluid manifold 42. Manifold 42 includes an outlet passage 44 for feeding fluid to the hydraulic system or load (not shown), and a return passage 46 that opens to chamber 40. Fluid from chamber 40 is drawn through a manifold passage 48 to the integrated motor/pump unit 34, and thence through check valve 18 within manifold 42 to accumulator 20 and passage 44. Dual pressure switch 22 is mounted externally of manifold 42, and is connected to passage 44 and accumulator 20 by a bypass passage 50. Motor control unit 28 controls application of electrical power to integrated motor/pump unit 34 in the manner described hereinabove in connection with FIG. 1.

We claim:

1. An electrophydraulic pump load control system that comprises:

an integrated fluid-cooled electric motor/hydraulic pump within a unitary assembly with means for internally circulating hydraulic fluid from an inlet through the motor to and through the pump to cool the motor, accumulator means coupled to said pump for storing a reserve of pump discharge fluid at a preselected pressure, pressure sensing means operatively coupled to said accumulator means for providing an electrical signal as a function of fluid pressure at said accumulator means, and motor control means for terminating application of electrical power to said motor when pressure at said accumulator means exceeds a first preselected pressure threshold, and thereafter gradually reapplying electrical power to said motor at a predetermined rate when pressure at said accumulator means decreases to a second preselected threshold less than said first threshold.

2. The system set forth in claim 1 wherein said pressure sensing means comprises a dual pressure switch.

3. The system set forth in claim 2 further comprising a check valve coupled between said pump and said accumulator means for preventing reverse flow of fluid to said pump when said motor is de-energized.

* * * * *